US006261056B1

(12) United States Patent
Wilson

(10) Patent No.: US 6,261,056 B1
(45) Date of Patent: Jul. 17, 2001

(54) CERAMIC TURBINE NOZZLE INCLUDING A RADIALLY SPLINED MOUNTING SURFACE

(75) Inventor: Daniel E. Wilson, Los Angeles, CA (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/404,224

(22) Filed: Sep. 23, 1999

(51) Int. Cl.[7] ..... F01D 9/00

(52) U.S. Cl. ..... 415/170.1; 415/191; 415/200; 415/209.3

(58) Field of Search ..... 415/170.1, 189, 415/190, 191, 200, 209.2, 209.3, 209.4, 210.1; 60/259

(56) References Cited

U.S. PATENT DOCUMENTS 4,363,602 * 12/1982 Martin ..... 416/230
4,579,705 4/1986 Matsuoka et al. .
4,713,206 12/1987 Matsushita et al. .
4,783,297 11/1988 Ito et al. .
4,854,025 8/1989 Oda et al. .
4,861,229 * 8/1989 Halstead ..... 415/138
5,031,400 7/1991 Boyd .
5,151,325 9/1992 Draskovich .
5,178,519 1/1993 Kawasaki et al. .
5,264,295 11/1993 Yoshikawa .
5,580,216 12/1996 Munsch .
5,580,219 12/1996 Frey et al. .
5,775,878 7/1998 Maumus et al. .

* cited by examiner

*Primary Examiner*—F. Daniel Lopez
*Assistant Examiner*—James M McAleenan
(74) *Attorney, Agent, or Firm*—William J. Zak, Jr. Esq.

(57) ABSTRACT

A ceramic nozzle for a gas turbine stage of a turbomachine (e.g., a turbopump) includes a splined mounting surface. Ceramic splines on the nozzle mounting surface are interlocked with metal mating splines on a surface of a turbine housing to prevent the nozzle from rotating relative to the housing. Both sets of splines extend in a radial direction, are straight and have trapezoidal shapes in transverse cross-section. These splines maintain a constant contact angle during large temperature excursions, when inherent thermal growth mismatches between ceramic and metal occur.

19 Claims, 2 Drawing Sheets

CERAMIC TURBINE NOZZLE INCLUDING A RADIALLY SPLINED MOUNTING SURFACE

BACKGROUND OF THE INVENTION

The present invention relates generally to the coupling of ceramic members to metal members. More specifically, the invention relates to a turbomachine including a ceramic nozzle that is coupled to a metal turbine housing.

Turbopumps are typically used for pumping fuel and oxidant to rocket engines. Rocket engine turbopumps are designed to operate at high shaft speeds and high horsepower in order to deliver high flow rates to the rocket engines.

A typical rocket engine turbopump includes a combustor and at least one turbine stage. In the first turbine stage, a nozzle directs hot, expanding gas from the combustor onto a rotor. The directed gas causes the rotor to rotate and create shaft work. The shaft work is used to pump the fuel and oxidant to the rocket engine.

The nozzle, which is secured to a turbine housing, is stationary with respect to the rotor. The nozzle directs the gas onto rotor vanes at an angle that produces maximum torque.

However, directing the gases creates a torque reaction on the nozzle. Torque on the nozzle can become extremely high, approaching several thousand foot-pounds. Such high torque is reacted by the turbine housing. Consequently, securing the nozzle to the turbine housing and keeping the nozzle stationary becomes a problem. Conventional approaches such as clamping the nozzle to the turbine housing and relying on friction to keep the nozzle stationary are ineffective.

Keeping the nozzle stationary becomes even more difficult if the nozzle and turbine housing are made of materials having different coefficients of thermal expansion. If the housing is made of metal and the nozzle is made of ceramic, the nozzle will expand at a different rate than the housing.

SUMMARY OF THE INVENTION

The present invention may be regarded as a nozzle for a turbine of a turbomachine. The nozzle comprises a hub and a ring having a mounting side; a plurality of splines on the mounting side; and a plurality of gas-directing vanes secured to the hub and ring. The hub, the ring, the vanes and the splines are made of a ceramic material. The ceramic splines are integral with the hub and ring.

The ceramic splines may be interlocked with mating splines on a metal structure, such as a turbine housing. The interlocked splines keep the nozzle stationary, even when the nozzle is subjected to thousands of foot-pounds of torque.

DETAILED DESCRIPTION OF THE INVENTION

Figure 1:
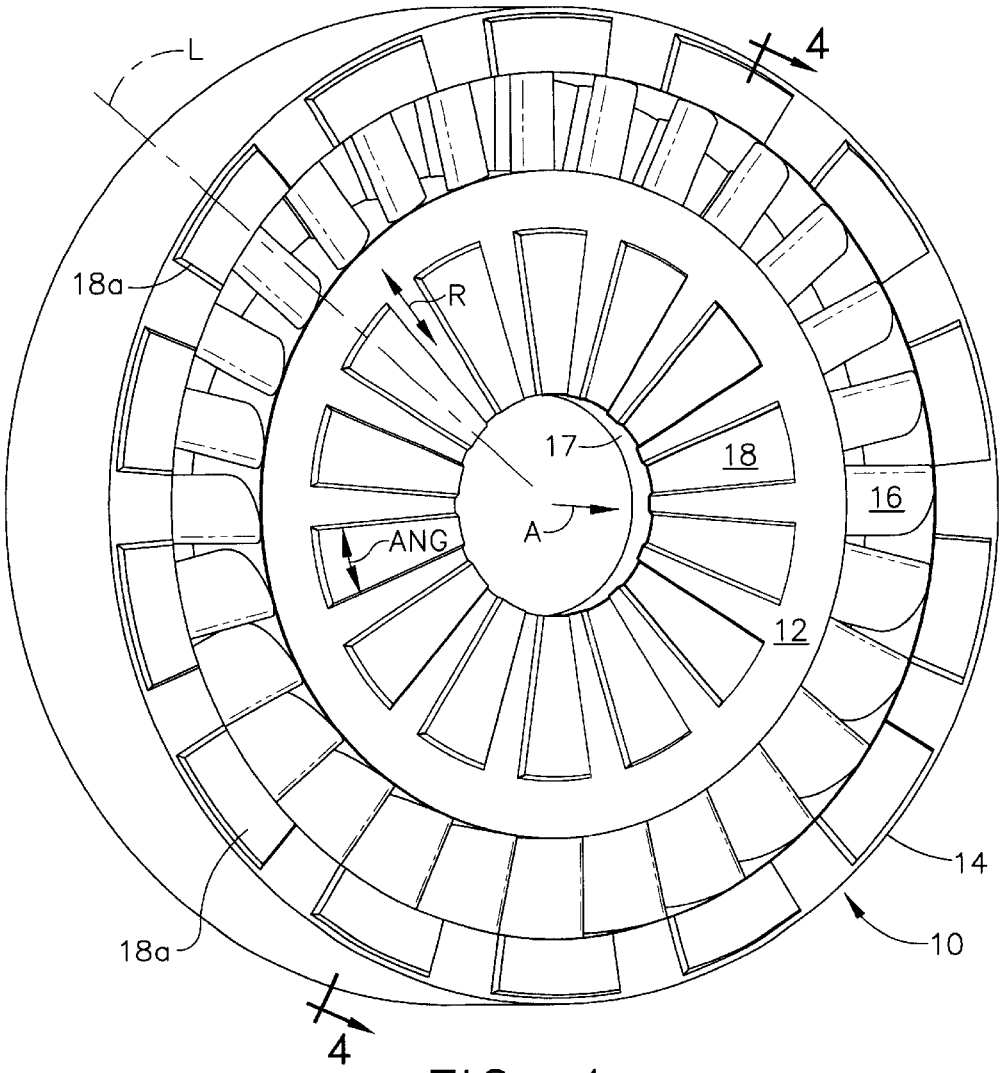
FIG. 1 is an illustration of a nozzle for a turbine stage of a turbomachine.
Figure 2:
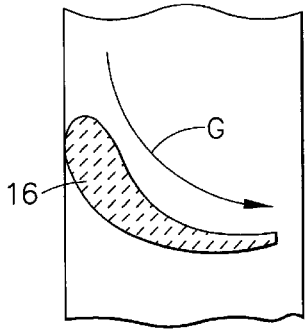
FIG. 2 is an illustration of a vane for the nozzle, the vane directing a gas stream.

FIG. 1 shows a ceramic nozzle 10 for a turbine stage of a turbomachine. The nozzle 10 includes a hub 12, an outer hub 14 (or second mounting surface) and a plurality of vanes 16 secured between hub the 12 ring and 14. The vanes 16 are arranged in a ring. A function of the vanes 16 is to direct incoming combustor gas G onto a rotor (see FIG. 2). For example, the vanes 16 could direct incoming gas from a radial direction to an axial direction. The radial direction is indicated by a first arrow R, and the axial direction is indicated by a second arrow A.

The hub 12 has a mounting side and a clamping side. The hub 12 also has a central aperture 17 extending from the clamping side to the mounting side. The mounting side is visible in FIG. 1 (the clamping side is on the reverse side).

Protruding from the mounting side of the hub 12 are a first plurality of splines 18. The splines 18 are formed on radial lines L and, therefore, extend in a radial direction. Protruding from a mounting side of the ring 14, along the same radial lines L, are a second plurality of splines 18*a*. Each spline 18 covers a constant angular width ANG.

The splines 18 and 18*a* may be continuous on the hub 12 and ring 14 or they may be split into multiple rings on the hub 12 and ring 14. FIG. 1 shows splines 18 and 18*a* that are continuous on the hubs 12 and ring 14. Splines may be formed on both the hub 12 and ring 14 (as shown in FIG. 1), or they may be formed on only the hub 12 or ring 14.

Figure 4:
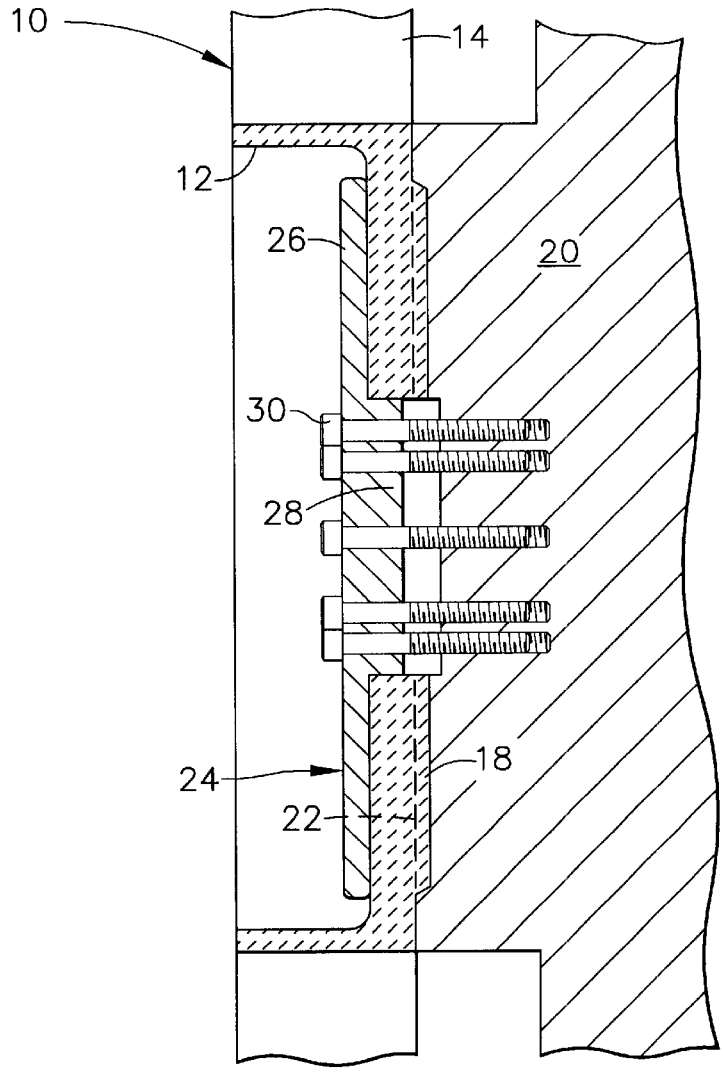
FIG. 4 is an illustration of the hub of the nozzle and a clamp for clamping the nozzle to a turbine housing, the nozzle, clamp and housing being shown in cross-section.

FIG. 4 shows the nozzle 10 secured to a metal housing 20. The metal housing 20 also has a mounting side and a plurality of mating splines 22 that protrude from the mounting side. The mating splines 22 are made of metal and are dimensioned to be interlocked with the ceramic splines 18 and 18*a* of the nozzle 10. The ceramic splines 18 and 18*a* make contact with the metal splines 22 at a contact angle.

With the metal and ceramic splines 22, 18 and 18*a* interlocked, a clamp 24 secures the nozzle 10 to the housing 20. The clamp 24 includes a clamping plate 26 and a clamping hub 28. The clamping hub 28 extends though the central aperture 17 in the hub 12 of the nozzle 10, and the clamping plate 26 is placed in contact with the clamping side of the nozzle hub 12. Clamping bolts 30 extending through the clamping hub 28 are threaded onto the metal housing 20.

The ceramic and metal splines 18, 18*a* and 22 prevent the nozzle 10 from rotating relative to the housing 20 in the presence of high reactionary torque. Moreover, the splines 18, 18*a* and 22 are shaped to prevent the nozzle 10 from shifting during large temperature excursions. During turbine operation, nozzle inlet temperatures can rise to about 1400° C. During this large temperature excursion, there occurs an inherent growth mismatch between the ceramic and the metal. As a result of this mismatch, the metal splines 22 expand faster than the ceramic splines 18 and 18*a*.

Figure 3:
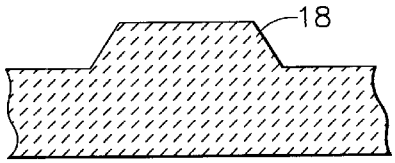
FIG. 3 is an illustration of a transverse cross-section of a spline on a mounting side of the nozzle.

However, the splines 18, 18*a* and 22 are made straight and trapezoidally-shaped in cross-section (see FIG. 3) to allow the mating surfaces to remain in contact, especially during large temperature excursions. The straight shape allows the ceramic and metal splines 18*a*, 18*b* and 22, which are expanding at different rates, to slide in a radial direction relative to one another. The trapezoidal transverse cross-section allows the splines 18, 18*a* and 22 to accommodate slight dimensional differences between the ceramic nozzle 10 and the metal housing 20 and thereby allow the surfaces to maintain the same contact angle.

In contrast, splines having square or rectangular shapes in crosssection might not eliminate the dimensional differences and, therefore, might not remain in precise contact during large temperature excursions. Consequently, point contact loading could occur. Severe point contact loading can cause the ceramic material to fail.

The ceramic splines 18 and 18*a* have a somewhat longer length than the metal splines 22. This difference accommodates the growth mismatch between the metal splines 22 and the ceramic splines 18 and 18*a*. Consequently, the metal and ceramic splines will be in contact at peak operating temperature and reactionary torque.

The hub 12, the ring 14, the vanes 16 and the splines 18 and 18*a* may be made of a ceramic material such as silicon nitride. For example, "AS 800" silicon nitride is a high strength structural ceramic that is capable of working to very high temperatures (1400° C.).

The first plurality of splines 18 is integral with the hub 12, and the second plurality of splines 18*a* is integral with the ring 14. The ring 14 and vanes 16 may also be integral with the hub 12. The nozzle 10 may be fabricated from a blank made of the ceramic material. The ceramic blank may have a raised surface. Using a CNC mill and a diamondimpregnated grinding wheel, grooves may be machined into the raised surface to form the ceramic splines 18 and 18*a*. If the vanes 16 are relatively long and straight, the vanes 16 and the ring 14 may also be machined into the ceramic blank.

Figure 5:
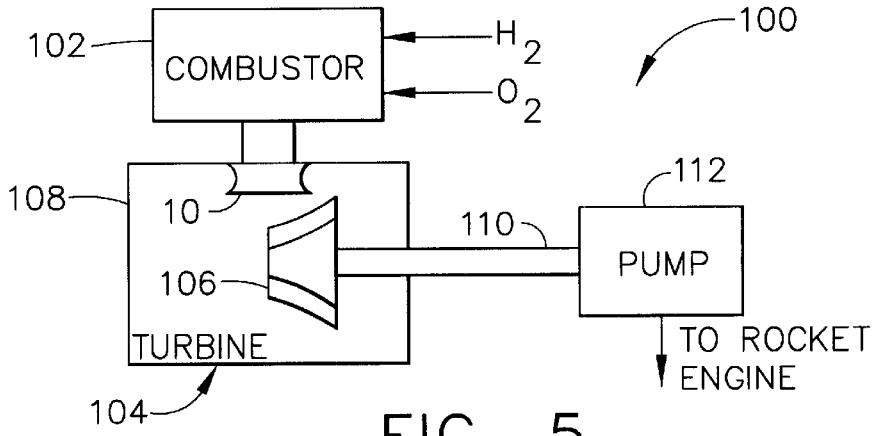
FIG. 5 is an illustration of a turbopump according to the present invention.

FIG. 5 shows a turbopump 100 including a combustor 102 and a turbine stage 104. Within the combustor 102, a fuel and an oxidant are mixed and ignited to produce a hot, expanding gas.

The turbine stage 104 includes a rotor 106, the nozzle 10 and a turbine housing 108 for the rotor 106 and the nozzle 10. The nozzle 10 directs the hot, expanding gas from the combustor 102 onto the rotor 106 at a maximum torque-producing angle. Directing the gas creates a reactionary torque that tends to rotate the nozzle 10. However, the ceramic and metal splines 18, 18*a* and 22 prevent the nozzle 10 from rotating. The directed gas causes the rotor 106 to rotate a shaft 110. Gas leaving the turbine stage 104 is exhausted.

A pump 112 is also coupled to the shaft 110. As the shaft 110 is rotated, it causes the pump 112 to pump fuel or oxidant to a rocket engine.

The turbopump 100 can accommodate at least 90,000 horsepower and turn between 45,000 and 50,000 rpm, yet fit in an envelope measuring no more than about eighteen inches in length and about fifteen inches in diameter. To generate such high horsepower, the combustor 102 ignites a fuel such as liquid hydrogen and an oxidant such as liquid oxygen. Hot, expanding gases from the ignited mixture can create a turbine inlet temperature in the neighborhood of 1400° F. Reactionary torque on the nozzle 10 can be in the neighborhood of 15,000 foot-pounds.

Contact angle of the splines 22 on the metal turbine housing 20 and the ceramic splines 18 and 18*a* on the nozzle 10 do not change under such high temperatures. Point contact loading is avoided, and the nozzle 10 remains stationary, even under such very high torque and temperature.

Thus disclosed is a nozzle that can be secured to a turbine housing while being subjected to high reactionary torque and large temperature excursions. The splines of the nozzle maintain the same contact angle with the mating splines of the housing, even if the nozzle and the housing are made of materials having different thermal expansion coefficients. Consequently, the nozzle may be made of a ceramic and the housing may be made of metal. Ceramic nozzles allow for higher turbine inlet temperatures than metal nozzles. Therefore, turbines including ceramic nozzles typically have higher thermodynamic efficiency than turbines including metal nozzles. Consequently, turbines including ceramics nozzles provide higher performance for the same package size, or they provide equal performance for a smaller package.

The invention is not limited to the specific embodiments described above. Although the turbopump is shown as having a single turbine stage, it is not so limited. The turbopump may have more than one turbine stage.

The nozzle is not limited to splines that extend in a radial direction. The splines may extend in other directions, provided that the same contact angle is maintained during large temperature excursions.

The nozzle is not limited to the central aperture and mounting bolts. Other ways of clamping the nozzle to the housing can be employed.

Nozzle size is application-specific. The number of splines is also application-specific. Although fourteen splines per hub are shown in FIG. 1, the nozzle could have more or fewer than fourteen splines.

The dimensions (e.g., length, height, width) of the metal and the ceramic splines are application-specific and dependent upon the applied torque, operating temperature and anticipated life. The clamping force is also application-specific and should be large enough to ensure that the ceramic and metal surfaces do no separate.

Therefore, the invention is not limited to the specific embodiments described above. Instead, the invention is construed according to the claims that follow.

What is claimed is:

1. A nozzle for a turbine of a turbomachine, the nozzle comprising:

a hub having a mounting side;

a plurality of splines on the mounting side; and a plurality of gas-directing vanes secured to the hub;

the hub, the vanes and the splines being made of a ceramic material, the splines being integral with the hub.

2. The nozzle of claim 1, wherein the spines extend in a radial direction on the mounting surface.

3. The nozzle of claim 1, wherein the splines protrude from the mounting surface.

4. The nozzle of claim 1, wherein the splines have a trapezoidal shape in transverse cross-section.

5. The nozzle of claim 1, wherein the splines are straight and elongated.

6. The nozzle of claim 1, wherein the splines are straight and elongated, extend along radial lines, and have a trapezoidal shape in transverse cross-section.

7. The nozzle of claim 1, further comprising a ring having the mounting surface and a second plurality of splines protruding from the mounting surface of the ring, the vanes being secured between the ring and hub.

8. A nozzle for a turbine stage of a turbomachine, the nozzle comprising:

a hub and a ring, the hub having a mounting side;

a plurality of vanes secured between the hub and the ring; and a plurality of radially-extending splines protruding from the mounting side of the hub, the splines being integral with the hub, the splines having a trapezoidal shape in transverse cross-section.

9. The nozzle of claim 8, wherein the splines are straight and elongated.

10. A turbine stage for a turbomachine, the turbine stage comprising:

a rotor;

a nozzle having a first mounting surface, the mounting surface having a first plurality of radially-extending splines; and a housing for the turbine stage, the housing having a second mounting surface, the second mounting surface having a second plurality of radially-extending radial splines;

the first plurality of radial splines being interlocked and making surface contact with the second plurality of radial splines;

the splines of the nozzle and the splines of the housing being made of materials having different coefficients of thermal expansion.

11. The turbine stage of claim 10, further comprising a clamp for clamping the nozzle to the housing.

12. The turbine stage of claim 10, wherein the nozzle splines are made of ceramic and the housing splines are made of metal.

13. The turbine stage of claim 10, wherein the splines are straight and elongated, have a constant angular width, and have a trapezoidal shape in transverse cross-section.

14. A turbopump for a rocket engine comprising:

a combustor;

a shaft;

a fluid pump coupled to the shaft;

a turbine stage including a ceramic nozzle and a rotor, the rotor being coupled to the shaft, the ceramic nozzle having a first mounting surface, the first mounting surface having a first plurality splines that extend in a radial direction; and a metal housing for the turbine stage, the housing having a second mounting surface, the second mounting surface having a second plurality of splines that extend in the radial direction;

the first plurality of splines being interlocked and making surface contact with the second plurality of splines.

15. The turbopump of claim 14, wherein the splines are straight and elongated, have a constant angular width, and have a trapezoidal shape in transverse cross-section.

16. The turbine stage of claim 10, wherein the splines have a trapezoidal shape in transverse cross-section.

17. The turbine stage of claim 12, wherein the nozzle splines are longer than the housing splines.

18. The turbopump of claim 14, wherein the splines have a trapezoidal shape in transverse cross-section.

19. The turbopump of claim 14, further comprising a clamp for clamping the nozzle to the housing.

* * * * *